US005421471A

United States Patent [19]

Burgan

[11] Patent Number: 5,421,471

[45] Date of Patent: Jun. 6, 1995

[54] ROLL-PROOF BOTTLE STOPPER

[76] Inventor: Hobart Burgan, 2504 NW. 119th St., Oklahoma City, Okla. 73120

[21] Appl. No.: 228,495

[22] Filed: Apr. 15, 1994

[51] Int. Cl.[6] ..... B65D 39/00

[52] U.S. Cl. ..... 215/355; 215/364

[58] Field of Search ..... 215/247, 296, 355, 356, 215/364; 220/376, 379, DIG. 19; D9/439, 441, 452; 217/78, 108, 110

[56] References Cited

U.S. PATENT DOCUMENTS

| | | | |
|---|---|---|---|
| D. 48,735 | 3/1916 | Orem | D9/439 |
| D. 147,027 | 7/1947 | Stevens, Jr. | D9/452 |
| D. 289,142 | 4/1987 | Bijaoui | D9/307 |
| D. 289,378 | 4/1987 | Miskinis | D9/439 |
| D. 318,618 | 7/1991 | Scarpa et al. | D9/400 |
| D. 333,269 | 2/1993 | Albright et al. | D9/544 |
| 773,435 | 10/1904 | Swindell | 215/355 |
| 802,562 | 10/1905 | Gilmore | 215/364 |
| 868,914 | 10/1907 | Dawson | 215/356 |
| 1,973,957 | 9/1934 | Johnson . | |
| 2,220,580 | 11/1940 | Penn | 215/364 |
| 4,202,334 | 5/1980 | Elson | 128/272 |
| 4,624,384 | 11/1986 | Ko | 220/212 |
| 5,047,273 | 9/1991 | Ernst-Cox et al. | D9/439 X |

*Primary Examiner*—Allan N. Shoap
*Assistant Examiner*—Vanessa Caretto
*Attorney, Agent, or Firm*—Dougherty, Hessin, Beavers & Gilbert

[57] ABSTRACT

A container stopper formed from deformable material that includes a lower, cylindrical stopper body unitarily formed with an upper cylindrical portion that extends roll-resistant configuration beyond the periphery of the stopper body.

3 Claims, 1 Drawing Sheet

ROLL-PROOF BOTTLE STOPPER

BACKGROUND OF THE INVENTION

1. Field of the Invention

The invention relates generally to bottle stoppers and, more particularly, but not by way of limitation, it relates to an improved form of stopper having a collar portion that renders a cork or stopper stationary when laid upon a flat or slightly tilted surface.

2. Description of the Prior Art

The prior art includes various types of cork and bottle stopper that have been utilized over a long period of years, and these include some particular tortuous shapes or addendum structure included for manipulation or stabilization usage. U.S. Pat. No. 4,202,334 illustrates a combination cap and stopper that is particularly adapted for medicine bottles as it accommodates insertion of a syringe. The stopper is also formed to have a large upper flange with two, opposed flat sides for the purpose of thumb/finger gripping to remove the stopper from its associated bottle. This stopper device is particularly adapted for sealing affixture of medicine bottles while still allowing insertion and entry of a syringe into contact with liquid contained therein. A U.S. Pat. No. 1,973,957 illustrates an early form of flanged stopper consisting of a tapering cork suspended from an upper disk and having a circular wire frame suspended to prevent the cork portion from coming into contact with any impure or unsterile surface when the bottle stopper is removed. Yet another patent teaching, U.S. Pat. No. 4,624,384, was discovered; however, this teaching only relates to a screw-on drinking container lid which included a stabilizer enlargement on one side for the purpose of preventing any rolling of the entire drinking container.

SUMMARY OF THE INVENTION

The present invention relates to an improved construction of bottle stopper or cork wherein a stopper of the generally conventional cylindrical type includes a narrow circumferal formation on one end thereof that is sufficiently multi-planar to prevent rolling of the stopper or cork when it is removed, expanded and laid to rest on a table or counter surface. The narrow collar having multi-planar surface may take any of several forms including circular with flat sides, square and polygonal so long as there is sufficient angular difference between adjacent planar surfaces to prevent rolling. In addition, it is contemplated that a portion of the stopper be tapered at the lower end in order to facilitate insertion and removal, this aspect being particularly desirable in the case of test tube stoppers and the like.

Therefore, it is an object of the present invention to provide a cork or bottle stopper of relatively simple formation that is resistive to rolling.

It is also an object of the present invention to provide a stopper formed from any of rubber, cork or plastic that is roll resistant.

Finally, it is an object of the invention to provide a cork stopper that is capable of total insertion within a bottle, yet capable of expanding multi-planar, roll-resistant surfaces when removed.

Other objects and advantages of the invention will be evident from the following detailed description when read in conjunction with the accompanying drawings which illustrate the invention.

DETAILED DESCRIPTION OF THE INVENTION

Figure 1:
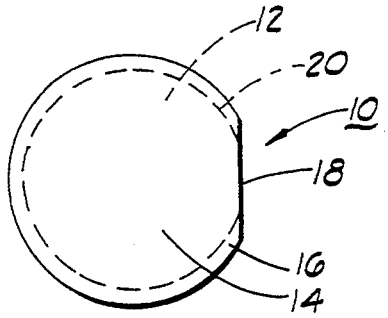
FIG. 1 is a top, plan view of one form of stopper constructed in accordance with the present invention.
Figure 2:
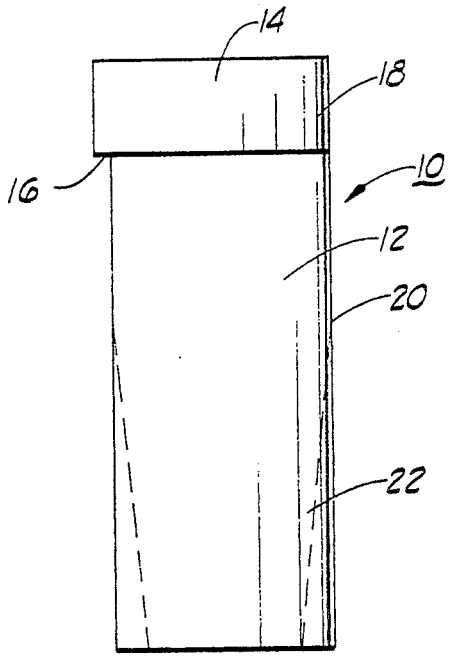
FIG. 2 is a view in side elevation of the stopper of FIG. 1 with taper option shown in dashed lines.

Referring to FIGS. 1 and 2, a container stopper 10 is formed from a pliable substance such as rubber, cork or suitable plastic and consists of a lower portion or stopper body 12, a cylindrical formation, unitarily formed with a flat, portion 14 at the upper end. The flat portion 14 is formed with a radius length in a ratio of approximately 6 to 5 to the radius of the cylindrical stopper body 12 such that the flat upper portion 14 has an annular overhang or flange 16. The height of flat portion 14 is approximately one-sixth the height of stopper body 12, and the radius of flat portion 14 is approximately one-sixth greater than the radius of stopper body 12. A planar chord 18 is then formed at a selected place on the circumfery of flat portion 14 such that the chord plane 18 is tangent to the peripheral wall 20 of stopper body 12.

Figure 3:
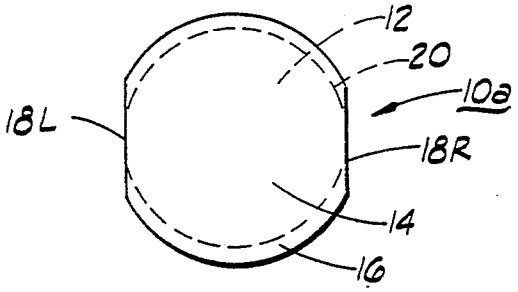
FIG. 3 is a top plan view of an alternative form of stopper.

The stopper 10 is preferably formed from a deformable material since in intended use it will be force fit into tight connection into a round necked container (not shown). The stopper 10 would be selected so that the peripheral wall 20 of stopper body 12 would have a diameter slightly larger than that of the interconnecting container neck or opening. As shown in FIG. 2, the dash lines 22 illustrate an optional structure wherein the lower portion of stopper body 12 is formed with a slight taper 22 for aid in insertion in the container. FIG. 3 illustrates yet another option wherein opposite sides of the flat portion 14 are formed as planar chords 18R and 18L, each tangent in relation to the peripheral wall 20 of stopper body 12.

Figure 4:
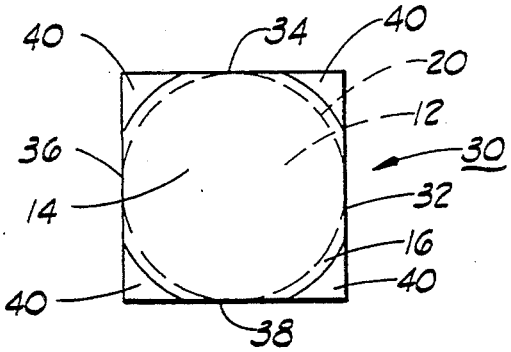
FIG. 4 is a top plan view of yet another alternative form of stopper.

FIG. 4 illustrates a stopper 30 that provides yet another alternative. Thus, with formation of the same basic stopper body 12 and flat portion 14, four quadrature disposed chords 32, 34, 36 and 38 are formed around the upper portion 14 with each lying tangent to the peripheral wall 20. It would not normally be necessary to include the corners 40 as portions of overhang 16; however, in certain uses such as shipboard laboratory use this may be desirable and corners 40 may certainly be included.

Figure 5:
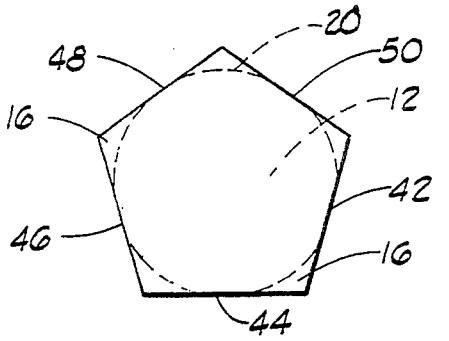
FIG. 5 is a top plan view of still another form of stopper.
Figure 6:
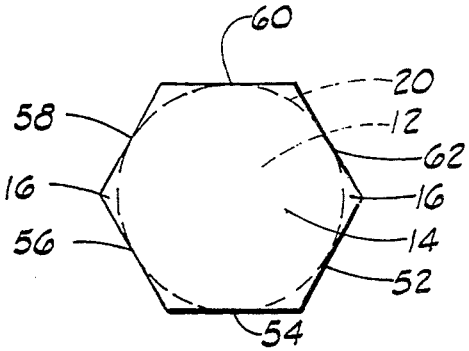
FIG. 6 is yet another top plan view of a form of roll-resistant stopper.

FIGS. 5 and 6 illustrate still additional structures wherein the flat portion 14 of previous Figures assumes respective pentagonal and hexagonal shapes. In FIG. 5, a series of chord planes 42, 44, 46, 48 and 50 around the periphery of portion 14 provide more than adequate roll resistance. The lower part of the stopper consisting of stopper body 12 having peripheral wall 20 is the same as in previous embodiments. Similarly, FIG. 6 includes a plurality of six chord planes 52, 54, 56, 58, 60, and 62 formed in sequence around the periphery of flat portion 14 as lower stopper body 12 remains the same. These multi-planar stoppers are only representative as three-, seven- and more planar peripheries can be used.

The foregoing discloses a novel form of deformable container stopper that is formed to be roll-resistant and stable when removed from its associated container and placed at rest. The container stoppers are particularly desirable for use with thin-walled test tubes and other laboratory containers used in testing since samples and/or container stoppers themselves can be laid on table tops without fear of rolling or being subjected to a damaging fall. In addition, some varieties of the container stopper are particularly desirable for use in corkage of wine bottles or the like where it is necessary to insert the cork totally and flush with the top of the bottle. Adequate deformability will allow such stopper entry, but it will still spring back into its original irregular shape when removed and laid down thereby to exhibit adequate roll-resistance.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A container stopper for a round necked container, comprising:

a cylindrical stopper body formed from pliable, deformable substance and having a diameter slightly larger than that of the round necked container so that the stopper body is inserted tightly under force; and a flat portion formed in one piece with said cylindrical stopper body, and along a common to axis therewith, the flat portion having a height approximately one-sixth the height of said cylindrical stopper body and a radius approximately one-sixth greater than the radius of the cylindrical stopper body, said flat portion having plural planes disposed in series to form the periphery;

whereby said plural planes are each formed as a chord of said flat portion that lies tangentially to the circumfery of said cylindrical stopper body, and wherein said container stopper body and flat portion define means for insertion of said stopper resiliently, deformably and totally within the said round necked container.

2. A container stopper as set forth in claim 1 wherein: said plurality of planes are five planes in pentagonal array.

3. A container stopper as set forth in claim 1 wherein: said plurality of plane are six planes in hexagonal array.

* * * * *